United States Patent [19]

Dean

[11] 4,401,062

[45] Aug. 30, 1983

[54] ROTARY PISTON ENGINE

[76] Inventor: Joe O. Dean, 5841 NE. 22nd Ave., Fort Lauderdale, Fla. 33308

[21] Appl. No.: 250,930

[22] Filed: Apr. 6, 1981

[51] Int. Cl.[3] ..... F02B 57/08

[52] U.S. Cl. ..... 123/44 E; 123/44 D

[58] Field of Search ..... 123/44 E, 43 C, 44 D; 74/567; 91/491; 418/263, 264

[56] References Cited

U.S. PATENT DOCUMENTS

| | | | |
|---|---|---|---|
| 741,059 | 10/1903 | Mullen | 418/263 |
| 1,282,824 | 10/1918 | Hartson | 123/44 E |
| 1,394,587 | 10/1921 | Stewart | 123/44 E |
| 1,699,009 | 1/1929 | Miller | 418/263 |
| 3,921,601 | 11/1975 | Maoz | 123/44 E |
| 4,022,167 | 5/1977 | Kristiansen | 123/43 AA |

*Primary Examiner*—Michael Koczo
*Assistant Examiner*—Peggy A. Loiacano
*Attorney, Agent, or Firm*—Brady, O'Boyle & Gates

[57] ABSTRACT

A rotor containing plural circumferentially spaced radial cylinders revolves in a concentric stationary housing around a fixed but adjustable profiled cam engaged by follower rollers on the connecting rods of pistons which reciprocate in the cylinders due to cam action during rotor rotation. A biasing spring for each piston maintains contact between the profiled cam and piston follower rollers. A secondary spring cushioned cam enables smooth transition of the piston follower rollers from an abrupt drop-off point on the main cam to a rotor torque inducing face thereof at the explosion point for each cylinder. Four cycle piston engine operation is achieved without the massiveness of a conventional fixed block piston engine of comparable displacement. The engine can be fuel injected or carburetor operated. Extreme simplicity of construction is achieved.

10 Claims, 7 Drawing Figures

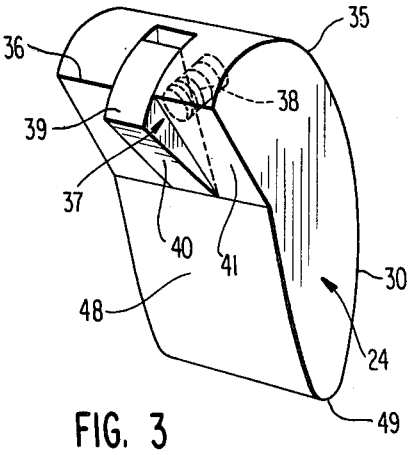
FIG. 3
FIG. 5
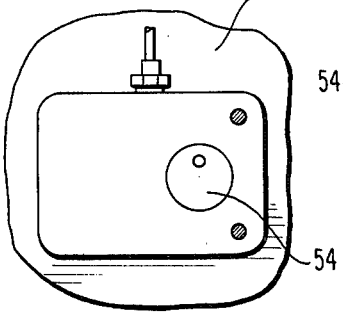
FIG. 4
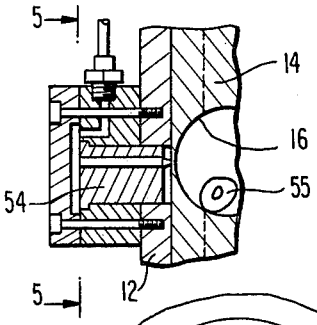
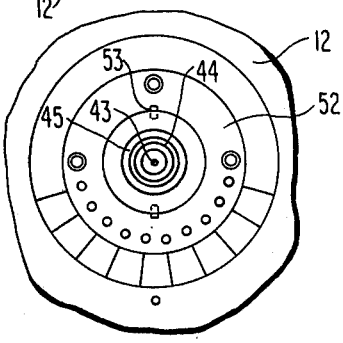
FIG. 6
FIG. 7
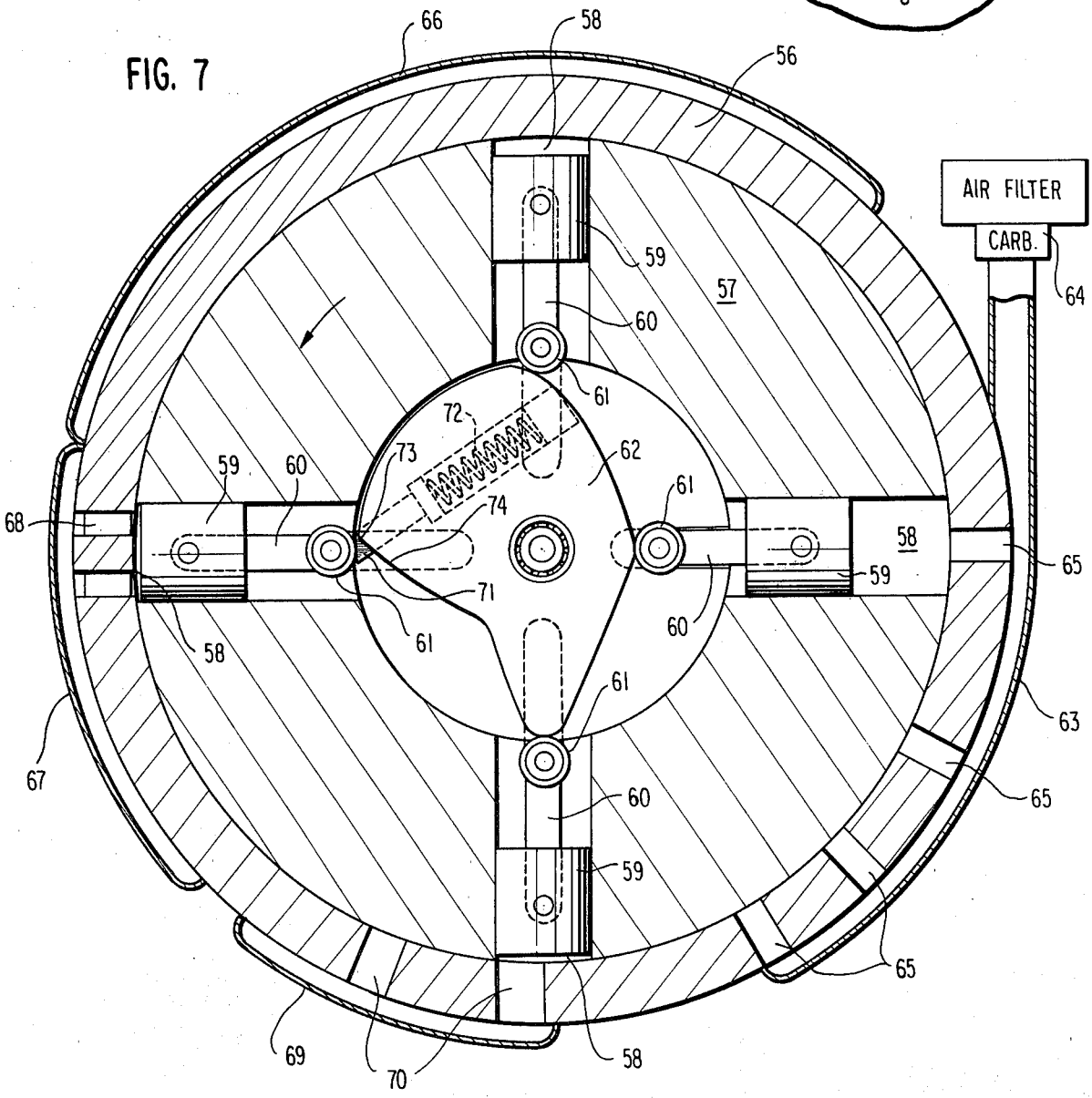

ROTARY PISTON ENGINE

BACKGROUND OF THE INVENTION

A variety of different types of rotary internal combustion engines are known in the patented prior art including rotary piston engines in which the piston rotor assembly is equipped with vanes or abutments against which the forces generated by fuel explosion react to produce rotation of the rotor assembly. Such engines, while varying in their specific configurations, all have a common drawback of excessive friction and rapid wear which greatly diminishes useful life of the engine and cuts its operational efficiency.

One prior art rotary engine which at least partly overcomes the above-stated drawback of engines having rotary abutments is disclosed in U.S. Pat. No. 4,182,301, issued to Joe O. Dean. This particular engine employs a system of low friction vane-piston rollers in intermeshing relationship on two counter-rotating rotors which are disposed eccentrically in two communicating chambers of a fixed housing. This patented engine closely simulates the operational cycles of a four stroke cycle piston engine with greatly reduced friction compared to most prior art rotary engines but is still lacking somewhat in simplicity of construction, minimized weight and low cost of manufacturing to satisfy completely the needs of the art.

The present invention seeks to completely satisfy the needs of the art for a low cost, highly simplified, minimal weight rotary piston engine which has a true four stroke operational cycle, reduced friction and improved operational efficiency in terms of usable power produced for a given total cylinder displacement in the engine.

A unique feature of the rotary piston engine in accordance with the present invention resides in the provision of a central satisfactory but rotationally adjustable cam which is profiled to dictate the four stages or phases of operation which collectively make up the four stroke cycle of a piston engine, namely, intake, compression, power and exhaust. The profiled surface of the stationary cam is followed by rollers on the connecting rods of the pistons which reciprocate in the several cylinder chambers of the engine rotor. The connecting rods carrying the cam follower rollers are not attached to the stationary profiled cam and are free to orbit around the cam with the rotor body pistons to thereby generate the necessary piston movements in a four cycle engine.

Other features and advantages of the invention over the prior art will become apparent during the course of the following detailed description.

BRIEF DESCRIPTION OF THE DRAWINGS

FIG. 3 is a perspective view showing a main cam and an auxiliary cam segment.

FIG. 4 is a fragmentary cross sectional view similar to FIG. 2 but in a different radial plane showing fuel injection means.

FIG. 5 is a fragmentary vertical section taken on line 5—5 of FIG. 4.

FIG. 6 is a fragmentary end elevation of the engine showing timing means.

FIG. 7 is a view similar to FIG. 1 showing a modification.

DETAILED DESCRIPTION

Figure 2:
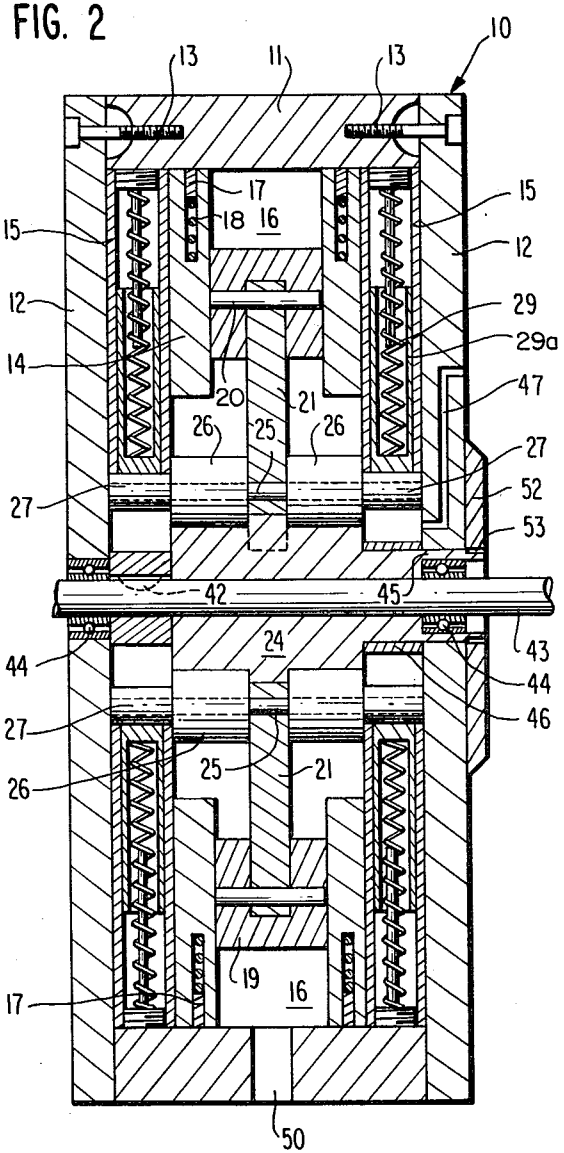
FIG. 2 is a central vertical section through the engine taken at right angles to FIG. 1.

Referring to the drawings in detail wherein like numerals designate like parts, a rotary piston engine comprises a stationary cylindrical housing 10 including a housing ring 11 which may contain coolant passages, not shown, and parallel housing end plates 12 attached by screws 13 to the housing ring.

A rotor assembly disposed in the housing 10 concentrically consists of a cylindrical rotor body 14 and rotor end plates 15 on opposite sides of the rotor body 14 and suitably fixed thereto. The rotor body 14 contains a plurality, such as eight, circumferentially equidistantly spaced radial cylinder chambers 16 opening radially through its concentric cylindrical faces. The rotor body 14 is equipped with a sealing ring 17 surrounding each cylinder chamber 16 urged radially outwardly by a compression spring 18 so that each ring has its outer radial end face in sealing contact with the bore of housing ring 11.

Contained within each cylinder chamber 16 is a reciprocating piston 19 connected by a wrist pin 20 with a connecting rod 21. Each connecting rod 21 has an inner radial end face 22 at right angles to the piston axis and an angled side face 23 offset from the piston axis whose function will be described.

Centrally of the rotor assembly is a relatively fixed but circumferentially adjustable profiled cam 24 which dictates piston travel during engine operation and establishes a four stroke cycle of operation for the rotary piston engine. Each connectng rod 21 near its inner radial end carries a transverse elongated or cross pin 25 extending on opposite sides thereof. This pin on each side of the connectig rod 21 carries a primary low friction cam follower rollers 26 and a smaller diameter roller or bushing 27 axially outwardly of the roller 26. The rollers 26 track on the exterior profiled face of fixed cam 24, as shown in the drawings.

Follower rollers 26 are maintained in contact with the profiled face of cam 24 by action of piston return springs 29 within cavities of the rotor end plates 15 acting on radial plungers **29*a* which bear on the rollers 27**.

The cam 24 is shaped to impart to the rotary piston engine a four stroke cycle of operation. Toward this end, the intake phase of the four stroke cycle is dictated by a comparatively flat portion 30 of the cam 24 covering about ninety degrees of rotor rotation where each successive piston 19 moves inwardly from an extreme outward position at the end of the exhaust phase of the four stroke cycle. In the ninety degree intake phase, a fuel air charge is inducted into each cylinder chamber 16 through circumferentially spaced induction ports 31 in housing ring 11, which communicate with an external intake manifold 32, upon which a carburetor 33 and air filter 34 are mounted if the engine employs a carburetion system. The option of fuel injection is also made available, as will be further described.

The compression phase of the four stroke cycle are spans ninety degrees of rotor rotation immediately following the intake phase, and the compression phase is enabled by an abruptly curved cam surface portion 35 of the stationary cam 24 following the flatter portion 30 and terminating in a sharp drop-off point 36. In traversing the cam portion 35, the engine pistons in succession are driven radially outwardly to gradually compress the charge in cylinder chambers 16 up to a point of maximum compression immediately preceding the explosion or power phase.

The power phase covers approximately sixty-seven and one-half degrees of rotor rotation immediately following the end of the compression phase and occurs as follows. As each cylinder 16 and piston 19 approaches top dead center shown at the nine o'clock position in FIG. 1 during counterclockwise rotor rotation, the cam follower rollers 26 for each piston will drop off of the cam shoulder or corner 36 just ahead of the top dead center position. To support and cushion each piston 19 at the instant of explosion, an auxiliary cam segment 37 or plate is pivotally held in a slot of the primary cam 24 at the radial plane common to the connecting rods 21. This auxiliary cam segment is biased outwardly of the primary cam 24 by a biasing spring 38 and plunger arrangement, as shown. The auxiliary cam segment has a curved face 39 and a straight inclined face 40 generally at right angles to the curved face 39. The primary cam 24 has a similar straight surface 41 at the drop-off point 36 forming an acute angle with the straight face 40 of the spring loaded auxiliary cam segment 37.

When the cam follower rollers 26 drop off of the shoulder 36 a few degrees ahead of top dead center, the flat end face 22 on each piston rod 21 normal to the piston axis slides over the curved face 39 of the auxiliary cam segment 37 and is momentarily supported thereby. Explosion will then occur at or near the nine o'clock top dead center position for each piston 16, depending on timing achieved by circumferential adjustment of cam elements 24 and 37 in a manner to be described. Assuming explosion at top dead center, the flat end face 22 of each piston rod 21 will be beyond the curved face 39, and the force of explosion driving each piston 16 inwardly will force the side inclined face 23 into sliding engagement with the straight face 40 of auxiliary spring loaded cam segment 37. This engagement will somewhat cushion the impact of explosion and offer some resistance to piston movement until the follower rollers 26 are guided into engagement with the straight face 41 of primary cam 24, the auxiliary cam segment yielding against spring force to produce a smooth transition at this critical point. The engagement of the faces 23 and 40 quickly followed by engagement of the rollers 26 with surface 41 will produce approximately forty-five degrees of rotor rotation immediately followig explosion within each cylinder of the engine. Thus, for an eight cylinder engine, as depicted, the power phase will generate three hundred sixty degrees of rotation in each four stroke cycle of operation.

Figure 1:
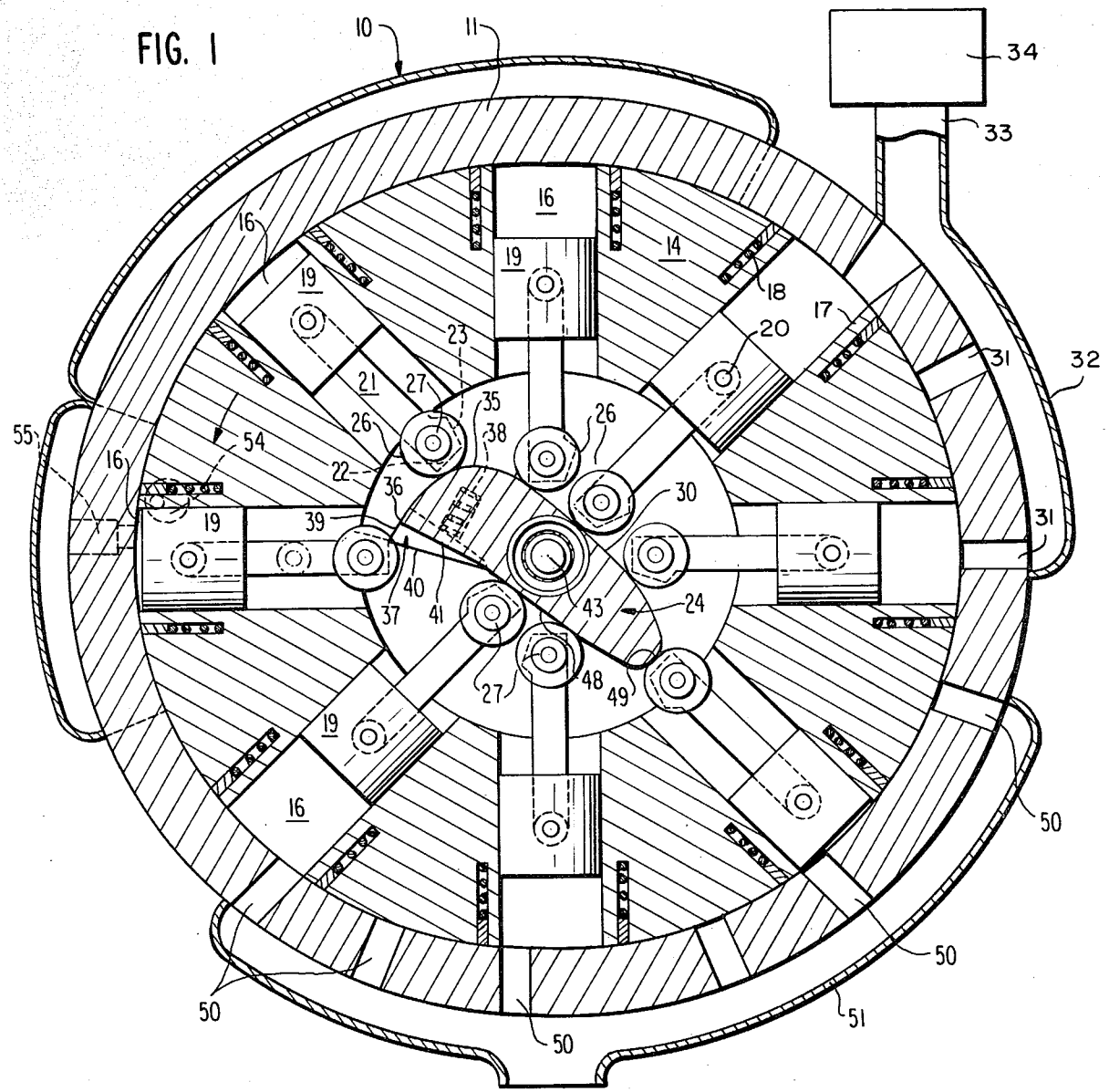
FIG. 1 is a vertical section through a rotary piston engine according to the invention taken at right angles to the rotor axis.

The reciprocation of each piston 16 following explosion at the nine o'clock position, FIG. 1, is converted to torque on the engine rotor by the interaction of the surfaces 23 and 40 and the interaction of the rollers 26 with the surface 41, as described.

The rotor is keyed at 42 to an engine output shaft 43 journaled in low friction bearings 44 supported in one housing end plate 12, and in an extension 45 of adjustable cam 24. The extension 45 is engaged in a sleeve bearing 46 around which the adjacent rotor end plate 15 revolves. The sleeve bearing 46 is lubricated through an oil passage 47, as shown in FIG. 2.

Following the power or combustion phase of the four stroke cycle, the exhaust phase commences and extends for approximately ninety degrees of engine circumference or rotation. The exhaust phase is regulated by another comparatively flat primary cam surface 48 commencing at the bottom of straight inclined torque generating surface 41 and terminating at an abrupt arcute surface 49 defining the transition zone between the exhaust and intake phases. While traversing cam surface 48, the rollers 26 cause each piston 19 in succession to be driven gradually outwardly to expel the burnt combustion products from each cylinder chamber 16 through several circumferentially spaced exhaust ports 50 in the housing ring 11, which ports lead into a common external exhaust manifold 51. Upon rounding the abrupt arcuate cam surface 49 which defines the end of the exhaust phase, the previously described intake or induction phase begins again as with any four cycle engine.

The engine is timed by rotational adjustment and locking of the cam 24. This adjusting or timing means is as described in connection with FIG. 5 of U.S. Pat. No. 4,182,301. Briefly, the timing dial 52 is splined at 53 to cam extension 45 whereby manual rotation of the dial 52 will turn the cam around the axis of rotation of the rotor, the dial 52 being lockable in the selected adjusted position as described in said prior patent.

In lieu of carburetion, the rotary piston engine can be injected with diesel fuel or gasoline by the injector means shown and described in the referenced prior patent, particularly the description in said patent relative to drawing FIGS. 3 and 4 thereof. The adjustable injector means described in said patent is indicated at 54 in FIG. 1 and is held on one end plate 12 of the engine housing. Similarly, as described in said patent, a glow plug or spark plug 55 is mounted in a provided opening of housing ring 11 so as to communicate with each oncoming cylinder chamber 16 which receives its fuel immediately prior to combustion from the injector means 54. It may be seen that the engine is versatile in its ability to operate as a diesel or as a spark ignition engine with carburetion or with injected gasoline or similar volatile fuel.

Another inherent advantage possessed by the simplified engine is the flywheel effect during operation of the rotor body 14, thus eliminating the need for a separate flywheel and the additional weight thereof commonly required on piston engines.

FIG. 7 shows a modification of the engine wherein four cylinders and pistons are employed in a four cycle operating mode in lieu of the eight cylinder arrangement shown in FIG. 1. Parts have been omitted in FIG. 7 for simplicity of illustration and therefore the view is somewhat schematic.

In FIG. 7, a housing ring 56 surrounds a rotor body 57 having four equidistantly spaced cylinder chambers 58 containing pistons 59 connected with piston rods 60. The inner radial ends of rods 60 carry follower rollers 61 which are biased to engage and follow the margin of a stationary cam 62 which is profiled to produce the previously-defined four cycle mode of operation.

An intake manifold 63 receives an air-fuel mixture from a carburetor 64 and delivers it to the rotating cylinders 58 in succession through intake ports 65. The arrangement is essentially described in the preceding embodiment.

The compression zone of the four cycle engine is indicated at 66 followed by the ignition and power zone at 67, a spark plug being indicated at 68. Finally, the exhaust zone of the four cylinder engine immediately follows the power zone and includes an exhaust manifold 69 receiving exhaust products from ports 70 in the ring housing 56. In general, the construction and mode of operation, except for the number of cylinders, is thus far the same as for the prior embodiment of the invention.

In the four cylinder embodiment of the rotary engine, the pivotal spring-urged cam segment 37, FIG. 1, is not utilized nor are the two piston rod surfaces 22 and 23 necessary. Instead, an auxiliary cam plunger 71 held within an opening of the main cam 62 is urged forwardly by a spring 72. During rotor rotation, as each roller 61 in succession falls off of a corner 73 of the main cam immediately ahead of ignition, the roller 61 will engage the tip of cam plunger 71 and be supported and cushioned thereby at the instant of explosion and immediately thereafter, until the roller 61 passes smoothly into contact with the nearly straight portion 74 of the main cam 62 and acts thereon to advance the rotor 57 during the power phase of the four cycle engine operation, generally as described in the prior embodiment.

While the rotary piston engine of the present invention has been described in connection with a four cycle piston engine operation, it is also adapted for use as a two cycle engine.

The many advantages possessed by the invention over the prior art should now be apparent to those skilled in the art without the necessity for further description.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A rotary piston engine comprising a relatively stationary housing, a rotor within the housing having a plurality of circumferentially spaced radial cylinder chambers, a corresponding number of reciprocating pistons in the cylinder chambers and revolving with said rotor within said housing, a stationary cam mounted centrally of the rotor and housing and profiled to produce reciprocation of each piston during rotor rotation in a manner to create a selected cycle of operation of each piston during each complete rotation of the rotor, cam follower means connected with each piston and movably engaging the profiled surface of said cam during rotor rotation, ignition means on said housing arranged to communicate with each cylinder chamber in succession during rotor rotation, said cam including an auxiliary spring loaded cam part located radially inwardly of the cam follower means to absorb the initial force of explosion in each cylinder chamber through contact with the cam follower means immediately following explosion, and said housing having circumferentially spaced intake and exhaust passage means adapted to communicate with each cylinder chamber in succession during rotor rotation and being circumferentially spaced from said ignition means.

2. A rotary piston engine as defined in claim 1, and movable means on said housing coupled with said cam, whereby the cam may be circumferentially adjusted to time the engine.

3. A rotary piston engine as defined in claim 1, and resilient means on the rotor engaging the cam follower means and biasing the latter into contact with the profiled surface of said cam during rotor rotation.

4. A rotary piston engine as defined in claim 3, and the cam follower means comprising a connecting rod coupled with each piston, a cross pin on the radially interior end of each connecting rod, and cam follower rollers on the cross pin.

5. A rotary piston engine as defined in claim 4, and additional rollers on each cross pin axially outwardly of said cam follower rollers and being in engagement with said resilient means and forming a part thereof.

6. A rotary piston engine as defined in claim 5, and an output shaft extending axially of said rotor and fixed thereto for rotation therewith relative to the housing and said stationary cam, and support bearings for the output shaft on axially spaced end walls of the housing.

7. A rotary piston engine as defined in claim 1, and said ignition means comprising an igniter plug fixed on said housing and arranged to communicate with each cylinder chamber in succession during rotor rotation and a coacting fuel injector fixed on the housing to communicate with each cylinder chamber in succession.

8. A rotary piston engine as defined in claim 1, and the cam follower means including a piston rod for each piston having a radial inner end abutment face and a side angled face, said auxiliary cam part having a first surface engaged by said piston rod abutment face and a second surface engaged by said side angled face immediately following disengagement of the end abutment face from said first surface, whereby the cam follower means has a smooth transition from the auxiliary spring loaded cam to the profiled surface of said stationary cam following explosion in each cylinder chamber.

9. A rotary piston engine as defined in claim 8, and the second surface of said auxiliary cam part comprising a straight surface inclined to the axis of each cylinder chamber at the explosion position thereof, and said stationary cam including a coacting straight surface having a different angle of inclination relative to the axis of each cylinder chamber at the explosion position thereof, said stationary cam having an abrupt drop-off point for the cam follower means at one terminal of the straight surface of the stationary cam.

10. A rotary piston engine comprising a relatively stationary housing, a rotor within the housing having a plurality of circumferentially spaced radial cylinder chambers, a corresponding number of reciprocating pistons in the cylinder chambers and revolving with said rotor within said housing, a stationary cam mounted centrally of the rotor and housing and profiled to produce reciprocation of each piston during rotor rotation in a manner to create a selected cycle of operation of each piston during each complete rotation of the rotor, cam follower means connected with each piston and movably engaging the profiled surface of said cam during rotor rotation, ignition means on said housing arranged to communicate with each cylinder chamber in succession during rotor rotation, said cam including an auxiliary spring-loaded cam plunger contained within said cam and having a tip projecting beyond the profiled margin of said cam to engage said cam follower means substantially at the instant of explosion in each cylinder and immediately thereafter to cushion the cam follower means as the latter moves smoothly into contact with an adjacent marginal portion of said cam which converts the power of explosion into rotation of said rotor, and said housing having circumferentially spaced intake and exhaust passage means adapted to communicate with each cylinder chamber in succession during rotor rotation and being circumferentially spaced from said ignition means.

* * * * *